US005626084A

United States Patent [19]

Kelly et al.

[11] Patent Number: 5,626,084

[45] Date of Patent: May 6, 1997

[54] SHELF AND LIGHT ASSEMBLY

[75] Inventors: Richard E. Kelly, Orland; Rodney A. Williams, Auburn, both of Ind.

[73] Assignee: Custom Lights, Inc., Kendallville, Ind.

[21] Appl. No.: 378,810

[22] Filed: Jan. 27, 1995

[51] Int. Cl.[6] ..... A47B 85/00

[52] U.S. Cl. ..... 108/23

[58] Field of Search ..... 108/23, 50; 312/223.5; 362/133, 127, 432

[56] References Cited

U.S. PATENT DOCUMENTS

| | | | |
|---|---|---|---|
| D. 79,072 | 7/1929 | Green . | |
| D. 118,272 | 12/1939 | Verhagen . | |
| D. 146,982 | 6/1947 | Phillips . | |
| D. 268,367 | 3/1983 | Paquette et al. . | |
| D. 330,090 | 10/1992 | Walter et al. . | |
| 1,927,837 | 9/1933 | Kingdon . | |
| 2,091,599 | 8/1937 | Larson et al. | 108/23 X |
| 2,838,355 | 6/1958 | Crowther | 108/23 X |
| 2,999,599 | 9/1961 | Jentzen | 108/23 |
| 3,613,604 | 10/1971 | Butler | 108/23 X |
| 4,154,492 | 5/1979 | Dunning, III | 362/133 X |
| 4,164,009 | 8/1979 | Maguire, Jr. et al. | 362/127 |
| 4,454,569 | 6/1984 | Maguire | 362/127 |
| 4,622,624 | 11/1986 | McCarthy et al. . | |
| 4,689,726 | 8/1987 | Kretzschmar . | |
| 4,799,133 | 1/1989 | Strzalko et al. . | |
| 4,994,943 | 2/1991 | Aspenhall | 362/432 X |
| 5,022,720 | 6/1991 | Fevig et al. | 312/223.5 |
| 5,034,861 | 7/1991 | Sklenak et al. . | |
| 5,079,680 | 1/1992 | Kohn | 362/127 |
| 5,226,719 | 7/1993 | Feldpausch et al. | 362/127 X |
| 5,287,252 | 2/1994 | Caruso . | |

FOREIGN PATENT DOCUMENTS

| | | | |
|---|---|---|---|
| 180713 | 6/1992 | Japan | 362/127 |
| 1379276 | 1/1975 | United Kingdom | 108/23 |
| 2255820 | 11/1992 | United Kingdom | 108/23 |

*Primary Examiner*—Jose V. Chen
*Attorney, Agent, or Firm*—Barnes & Thornburg

[57] ABSTRACT

A shelf and light assembly having a self, a light module and a lens element. The light module is removably secured to the shelf by cooperating engaging structures on the shelf and the light module. The lens element is supported on one side by the light module and on an opposite side by the shelf. The lens element prevents the light module from becoming disengaged from the shelf.

36 Claims, 3 Drawing Sheets

SHELF AND LIGHT ASSEMBLY

The present invention relates to a shelf and light assembly having a light module that cooperates with structure on the shelf to removably secure the light module in a mounted position to the shelf.

Shelves with light assemblies are known. In some designs, the light assembly is attached to a shelf which may be part of an item of furniture, such as a desk, or a free-standing structure used for storage or display. In these designs, a bracket or other holder is secured to the shelf by a fastener such as a screw or rivet. One or more lamps or light bulbs are attached to the bracket or holder.

In other designs, the light assembly includes a housing that is formed to have a plurality of slots that each receive at least one fastener that is secured to the shelf. Each slot is configured so that it includes a first portion that is adapted to slidably receive a head of the fastener and a second portion that is adapted to engage the head of the fastener thereby mounting the light assembly to the shelf. The light assembly is removed from the shelf by removing the head of each fastener from the second portion and sliding the fastener out of the first portion.

These designs are problematic in that loose mounting hardware, such as brackets, screws, and holders, must be attached to the shelf before a light source is installed. Attachment of such loose hardware is time consuming, expensive, and may require use of tools. Another problem of these designs is that removal of the light, for such things as service, is time-consuming and may require use of tools. A further problem with such designs is that the use of mounting hardware often detracts from the aesthetics of such light assemblies and furniture.

An assembly that addressed these problems would be a welcome improvement. Accordingly, the present invention includes a shelf and a light module. The light module includes a housing, a portion of which cooperates with structure on the shelf to removably secure the light module to the shelf in a mounted position. In one embodiment, the present invention includes a lens that is disposed adjacent the light module and supported on a first side by the shelf and on a second side by the housing. The lens cooperates with the housing and shelf to secure the light module against removal from the mounted position. In this embodiment of the invention, the housing is formed of folded metal and includes a flange projecting from a sidewall of the housing that is positioned adjacent to and supports the lens.

The housing includes a pair of opposing end walls and the portion of the housing cooperating with structure on the shelf includes a slot formed in each of the end walls. The structure on the shelf may include at least one projecting member that is received in each of the slots. These projecting members may include one or more mounting pins that are received in each of the slots.

The slot may include first and second portions that are substantially orthogonally related. Each mounting pin may be positionable in the second portion of the slot to secure the light module against removal when the light module is in the mounted position. In the embodiment of the present invention with the mounting pins, the number of second portions may correspond with the number of mounting pins. Each slot may extend along a longitudinal length of an end wall of the housing such that a first open end of the slot is adjacent an edge of the end wall through which one or more adjacent projecting members of the shelf are introduced into the slot. In this embodiment, the housing may include a sidewall extending between the opposing end walls that is formed to include a recessed portion adjacent the open end of the first portion of each slot to provide clearance for each mounting pin. The second portions may be formed as detents that align with the projecting members in the slots when the light module is in the mounted position.

The structure on the shelf may project into an area beneath the shelf. In such embodiments, the shelf may include a pair of depending end walls and the structure on the shelf may include a pair of mounting pins coupled to the end walls of the shelf. The shelf may include a stepped edge surface. The first side of the lens rests on a portion of this stepped edge surface. Alternatively, the edge surface of the shelf may be formed to include a flange on which the first side of the lens nests.

The present invention may also include a reflector that is disposed beneath the shelf. The reflector includes a first edge surface that abuts a portion of the housing and a second edge surface that abuts a portion of the shelf so that the reflector is secured beneath the shelf. In the embodiment of the light module that includes the housing having a flange and the shelf having a stepped edge surface, the first edge surface of the reflector abuts the flange and the second edge surface abuts the stepped edge surface of the shelf. The reflector can be formed to include one or more cut-out portions so that the reflector is positionable between a bulb or lamp of the light module and the housing.

The present invention also relates to a method of installing a light assembly beneath a shelf. The method includes the steps of positioning the light module beneath the shelf so that each projecting member is adjacent one of the slots formed in the housing. Each projecting member is then guided through an open end of an adjacent slot to dispose the projecting member within the first portion of the slot. Next, the projecting members are positioned into the second portions of the slots to removably secure the light module in the mounted position beneath the shelf.

The method of the present invention further includes the step of positioning the lens adjacent the housing of the light module and the shelf so that the lens cooperates with the light module and shelf to secure the light module against removal in the mounted position. A sequence of steps for the method of installing the lens includes positioning a first edge surface of the lens onto the edge surface of the shelf, next positioning a second edge surface of the lens adjacent a flange of the housing, and then guiding the second edge surface of the lens onto the flange of the housing.

The present invention may also include the steps of positioning the first edge of the reflector adjacent the housing of the light module and positioning the second edge surface of the reflector adjacent the shelf to thereby secure the reflector beneath the shelf.

Other objects, advantages and novel features of the present invention will become apparent from the following detailed description of the invention when considered in conjunction with the accompanying drawings.

DETAILED DESCRIPTION OF THE DRAWINGS

Figure 1:
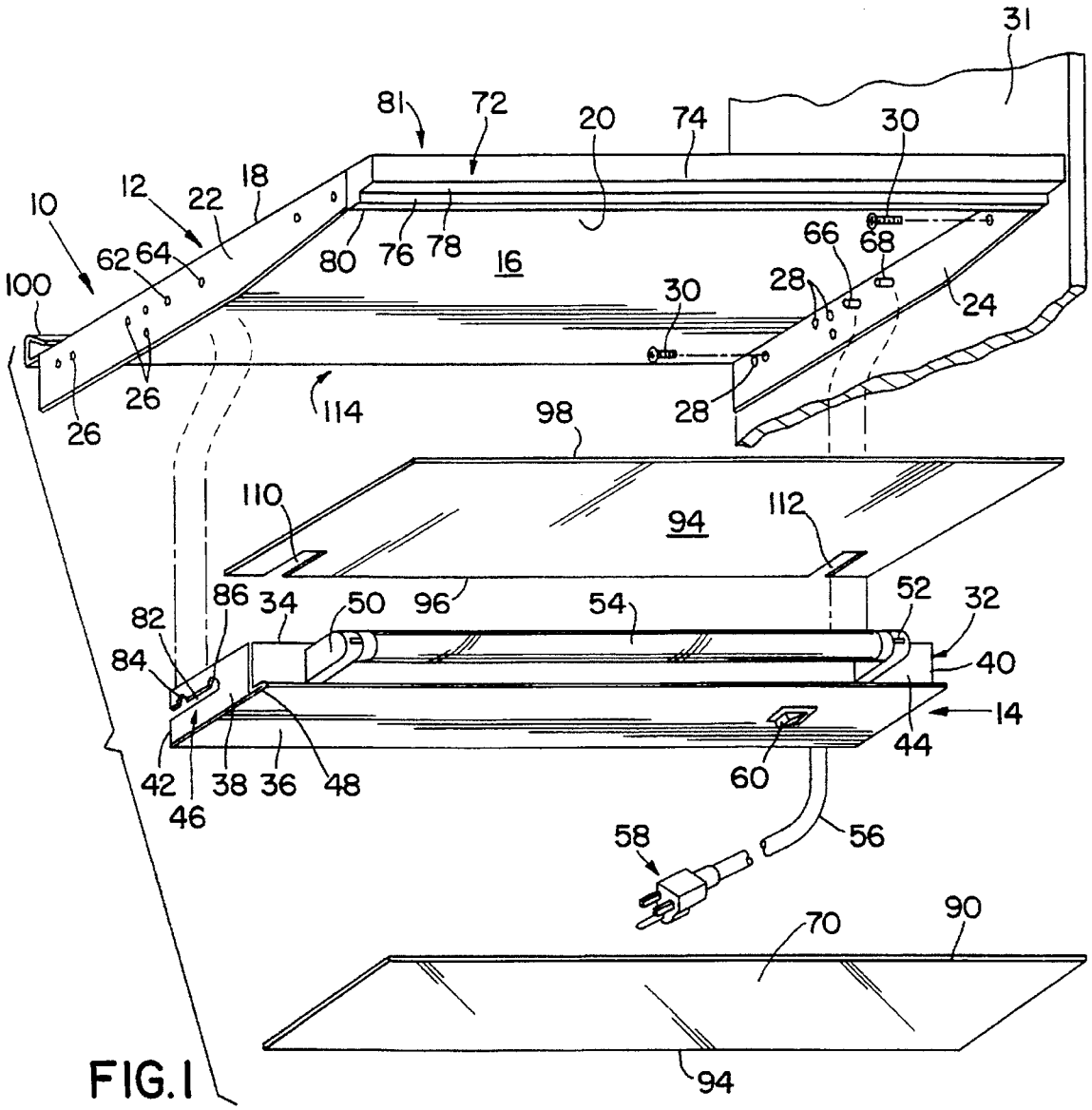
FIG. 1 is an exploded perspective view of an embodiment of the shelf and light assembly of the present invention.

A shelf and light module assembly 10 of the present invention is shown in an exploded perspective view in FIG. 1. Assembly 10 includes a shelf 12 and a light module 14. In a an embodiment of the present invention, shelf 12 is formed from metal and includes a top wall 16 having a top surface 18 (as shown in the side view of assembly 10 in FIG. 3) and an opposing bottom surface 20. Shelf 12 is also formed to include a pair of opposing depending end walls 22 and 24 that are each formed to include a plurality of respective holes 26 and 28 that receive fasteners 30 (see FIG. 3) to couple shelf 12 to support members 31, one of which is shown in FIG. 1.

Light module 14 includes a housing 32, which in the embodiment shown, is formed from folded metal. Housing 32 includes a top wall 34 and an opposing bottom wall 36. Housing 32 also includes a pair of opposing end walls 38 and 40 as well as a pair of opposing sidewalls 42 and 44 which lie between end walls 38 and 40. A mounting slot 46 is shown as being formed in end wall 38. Although not shown, a substantially identical mounting slot is formed in end wall 40. The function of mounting slot 46 in end wall 38 as well as the mounting slot in end wall 40 is discussed below.

Figure 3:
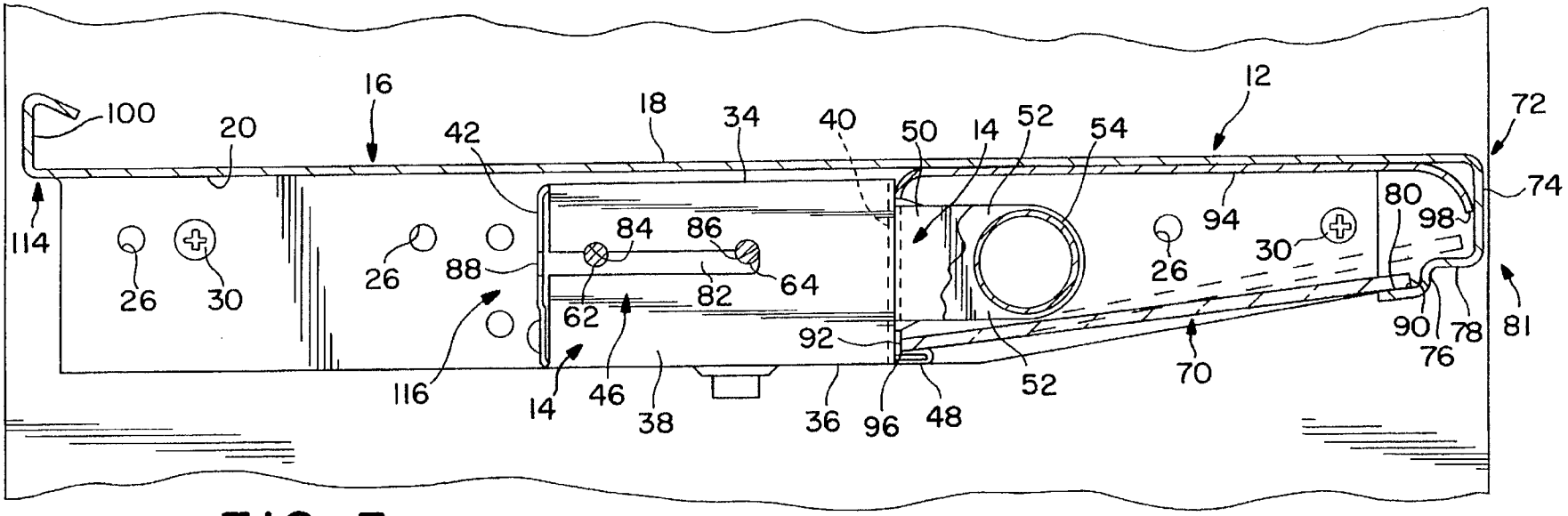
FIG. 3 is a side view of an assembled shelf and light assembly of the present invention.

Housing 32 is also formed to include a flange 48 which projects from bottom wall 36 and sidewall 44 as shown in FIGS. 1 and 3. As can be seen in FIG. 3, flange 48 may be formed by bending a portion of bottom wall 36 over a bent portion of sidewall 44. As with mounting slot 46 in end wall 38 and the mounting slot in end wall 40, the purpose of flange 48 is discussed more fully below.

Light module 14 also includes a pair of sockets 50 and 52 into which bulb or lamp 54 is positioned to lie. A cord 56 having a standard three prong electrical plug 58 provides power to module 14. A switch 60 turns bulb or lamp 54 on and off. Light module 14 shown in the drawings includes the standard electrical components required for operation of a fluorescent lamp, such as a ballast. Although a fluorescent lamp is shown, it is to be understood that the present invention is not limited to such lamps and can be used with other types of light modules such as those for incandescent bulbs.

A pair of projecting members 62 and 64 are coupled to depending end wall 22 and a pair of projecting members 66 and 68 are coupled to depending end wall 24. Projecting members 62, 64, 66, and 68 may be coupled to end walls 22 and 24 in any suitable manner. For example, projecting members 62, 64, 66, and 68 may be swaged, welded, integrally formed, or fastened to end walls 22 and 24. As can be best be seen in FIG. 1, projecting members 62, 64, 66, and 68 are configured in the shape of pins that inwardly project into a partially open area defined by bottom surface 20, end walls 22 and 24, and edge 72 of shelf 12.

Figure 2:
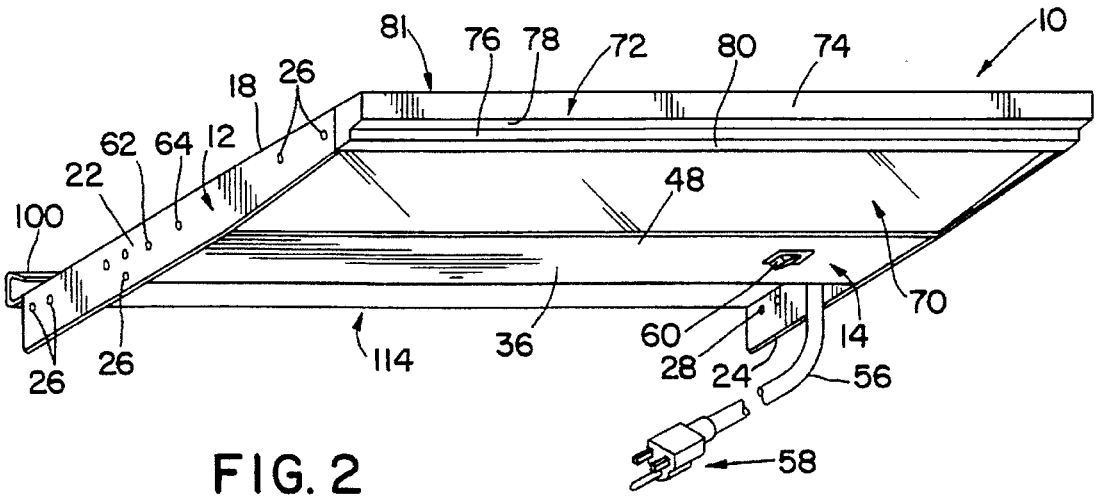
FIG. 2 is an assembled perspective view of the shelf and light assembly of FIG. 1.

Projecting members 62 and 64 are received in mounting slot 46 formed in end wall 38 and projecting members 66 and 68 are received in the mounting slot formed in end wall 40 to removably secure light module 14 to shelf 12 in a mounted position as shown in FIGS. 2 and 3. Projecting members 62 and 64, as well as projecting members 66 and 68, are spaced apart a predetermined distance, as shown in FIGS. 1 and 3 in order to help reduce wobbling of light module 14 in the mounted position. Although two projecting members are shown as being coupled to each end wall 22 and 24, it is to be understood that only one projecting member coupled to each end wall is necessary to removably secure light module 14 in the mounted position beneath shelf 12. Alternatively, although two projecting members are shown coupled to each end wall, it is to be understood that more than two such members may be coupled to each end wall to removably secure light module 14 in the mounted position beneath shelf 12.

The location of projecting members 62, 64, 66, and 68 on shelf 12 can be changed depending upon such things as the manner and location in which it is desired to removably secure light module 14 in a mounted position to shelf 12. For example, the projecting members could be coupled to top wall 16 of shelf 12 rather than depending end walls 22 and 24. Of course, changing the location of projecting members 62, 64, 66, and 68 may require reconfiguration of housing 32 of light module 14 so that the mounting slots formed therein will receive the newly located projecting members.

A further variation of the mounting arrangement of the present invention can be obtained by switching the location of the projecting members and mounting slots. For example, shelf 12 could be formed to include a pair of mounting slots that each receive one or more projecting members coupled to light module 14. One of these mounting slots could be formed in each of depending end walls 22 and 24 of shelf 12 to receive one or more projecting members coupled to end walls 38 and 40 of housing 32 of light module 14.

Light module 14 also includes a lens 70 that is disposed adjacent housing 32 of light module 14 and edge 72 of shelf 12. Lens 70 helps focus light from bulb or lamp 54 and also helps to protect it as is known. Lens 70 of the present invention cooperates with housing 32 and shelf 12 to secure light module 14 against removal in the mounted position. As can best be seen in FIG. 3, lens 70 includes a first edge or side surface 90 that is supported by edge 72 of shelf 12 and a second edge or side surface 92 that is supported by flange 48 of housing 32.

In the embodiment shown, edge 72 of shelf 12 is formed to include respective first and second substantially vertical walls 74 and 76 that are joined together by a first substantially horizontal wall 78. Edge 72 of shelf 12 is further formed to include a second substantially horizontal wall 80 on which first edge or side surface 90 of lens 70 is positioned to lie as discussed above. Although the terms "vertical" and "horizontal" are used in describing walls 74, 76, 78, and 80, it is to be understood that these adjectives are non-limiting and merely refer to the relative orientation of walls 74 and 76 to walls 78 and 80. That is, walls 74 and 76 are substantially orthogonal to walls 78 and 80. The terms "horizontal" and "vertical" are applicable when shelf 12 of assembly 10 shown in the drawings is coupled to substantially vertical support members via fasteners 30 as discussed above. Edge 72 of shelf 12 is formed to include the plurality of the above-described walls to narrow the profile or width of shelf 12 as viewed from front 81 of assembly 10.

Figure 4:
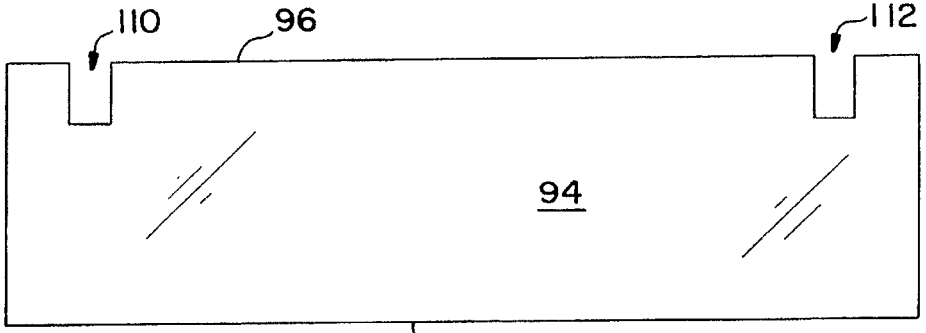
FIG. 4 is a top view of an embodiment of a reflector of the present invention that is secured beneath a shelf by having a first edge surface abutting a portion of the housing and a second edge surface abutting a portion of the shelf.
Figure 3A:
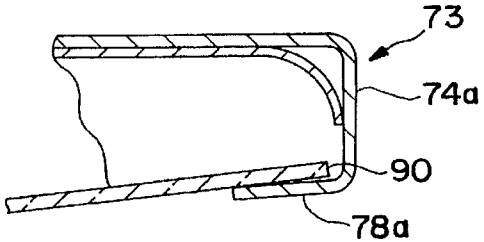
FIG. 3*a* side view of an alternative embodiment of an edge of shelf shown in FIG. 3.

FIG. 3*a* shows an alternative embodiment of a shelf having a "non-stepped" edge 73. As shown in FIG. 4, edge 73 has only one substantially vertical wall 74*a* and one substantially horizontal wall or flange 78*a* on which first edge or side surface 90 of lens 70 is positioned to lie.

As can be best be seen in FIG. 3, mounting slot 46 formed in end wall 38 includes a first portion 82 and a pair of detents or second portions 84 and 86. Although not shown, it is to be understood that the mounting slot formed in end wall 40 of housing 32 includes such detents or first and second portions as well. In addition, the discussion that follows with regard to the characteristics of mounting slot 46 formed in end wall 38 also applies to the mounting slot formed in end wall 40.

As can be seen in FIG. 3, first and second portions 84 and 86 are formed in end wall 38 so as to be substantially orthogonal to one another. As can also be seen, second portion 84 receives projecting member 62 and second portion 86 receives projecting member 64 when light module 14 is in the mounted position beneath shelf 12. Second portions 84 and 86 are formed in mounting slot 46 to further help secure light module 14 in a mounted position. In the embodiment illustrated, second portions 84 and 86 are formed as detents in first portion 82. Although the number of second portions formed in slot 46 corresponds to the number of projecting members coupled to end wall 22, it is to be understood that this is not a limitation of the present invention. For example, in some embodiments of the present invention, only one second portion is formed in mounting slot 46 to receive a projecting member coupled to a sidewall of the shelf. Alternatively, in other embodiments, mounting slot 46 may be formed to include only a first portion 82 that receives projecting members coupled to sidewall 22 with no second portions being formed therein.

Sidewall 42 of housing 32 is formed to include a slot 88 adjacent first portion 82 of mounting slot 46 as well as an opposing slot (not shown) adjacent the first portion of the mounting slot formed in end wall 40. Slot 88 provides clearance for projecting members 62 and 64 when they are introduced into slot 46 to removably secure light module 14 in the mounted position beneath shelf 12. The slot (not shown) formed in end wall 40 provides the same clearance for projecting members 66 and 68 when they are introduced into the first portion of the mounting slot formed in end wall 40 of housing 32 as discussed above.

Assembly 10 further includes a reflector 94 that is disposed adjacent light module 14 and shelf 12. Reflector 94 helps focus and concentrate light from lamp or bulb 54 as is known. As is shown in the drawings, reflector 94 includes a first edge surface 96 that abuts flange 48 of housing 32 and a second edge surface 98 that abuts edge 72 of shelf 12 to secure reflector 94 beneath and adjacent bottom surface 20 of shelf 12. Reflector 94 is made from conventional materials used for such reflectors such as vinyl and has a light reflecting color such as white.

As can be seen in FIG. 4, reflector 94 is configured to include a pair of cut-out portions 110 and 112 in first edge surface 96. Cut-out portions 110 and 112 provide clearance for sockets 50 and 52 of light module 14 when first edge surface 96 is positioned on flange 48 of housing 32. This allows reflector 94 to be installed between housing 32 and bulb or lamp 54.

As can be seen in FIGS. 1–3, shelf 12 is formed to include a bracket 100 in a rearward portion 114 (see FIG. 3) of shelf 12. In the embodiment shown in the drawings, bracket 100 allows dividers (not shown) to be positioned and supported along top surface 18 of shelf 12. Bracket 100 may be formed along all or a portion of the width of rearward portion 114 of shelf 12. It is to be understood, however, that shelf 12 may also be formed without such a bracket. In addition, although not shown, it is within the scope of the present invention to form shelf 12 to include other organizational and space management structure for adapting shelf 12 to the needs of its user.

Figure 5:
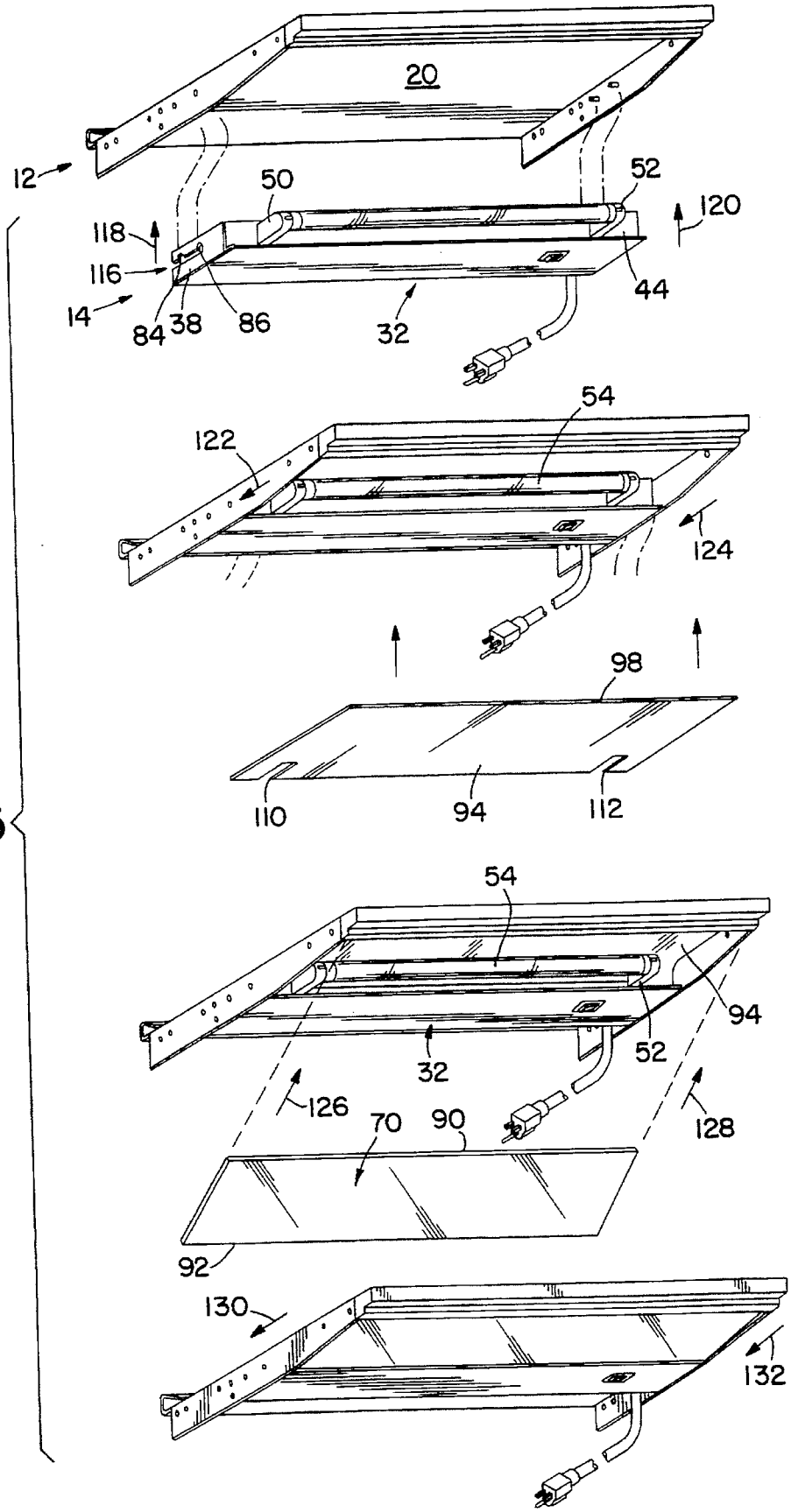
FIG. 5 is a view illustrating a method of the present invention used to install the light module, reflector, and lens of the present invention beneath the shelf.

The present invention also includes a method of installing a light assembly beneath a shelf. As shown in FIG. 5, the method includes the steps of positioning light module 14 beneath and below bottom surface 20 of shelf 12 so that open end 116 of mounting slot 46 in end wall 38 and the open end of the mounting slot in end wall 40 (not shown) are positioned toward rearward portion 114 of shelf 12. Light module 14 is next moved upward toward bottom surface 20 of shelf 12 in the direction generally indicated by arrows 118 and 120 so that projecting members 62 and 64 are positioned adjacent open end 116 of mounting slot 46 and projecting members 66 and 68 are positioned adjacent the open end of the mounting slot formed in end wall 40. Projecting members 62, 64, 66, and 68 are next guided through the open ends of the adjacent mounting slots to dispose the projecting members within the first portions of the slots. This is accomplished by moving light module 14 in the direction generally indicated by arrows 122 and 124 toward rearward portion 114 of shelf 14, as shown in FIG. 5. Light module 14 is moved in the direction generally indicated by arrows 122 and 124 until projecting members 62 and 64 are positioned to lie in portions 84 and 86 and projecting members 66 and 68 are positioned to lie within the portions formed in the mounting slot in end wall 40 discussed above. This removably secures light module 14 in a mounted position beneath shelf 12.

Reflector 94 is next secured adjacent bottom surface 20 of shelf 12 by positioning first edge surface of reflector 94 adjacent sidewall 44 of housing 32 so that sockets 50 and 52 are disposed through cut-outs 110 and 112 and positioning second edge surface 98 adjacent edge 72 of shelf 12 or, alternatively, edge 73 as shown in FIG. 5.

Lens 70 is next installed by positioning first edge or side surface 90 (not shown) onto either first or second horizontal walls 78 and 80 of stepped edge surface 72 as indicated by arrows 126 and 128 in FIG. 5 or, alternatively, horizontal wall **78*a* of non-stepped edge surface 73. Next, second edge or side surface 92 of lens 70 is positioned adjacent flange 48 of housing 32 and guided onto flange 48 by moving lens 70 toward rearward portion 114 as generally indicated by arrows 130 and 132 in FIG. 5**.

As discussed above, once second edge or side surface 92 of lens 70 is on flange 48, light module 14 is secured against removal in its mounted position beneath shelf 12. However, light module 14 can be removed from its mounted position beneath shelf 12 by reversing the sequence of steps described above. That is, second edge or side surface 92 would first be removed from flange 48 by guiding it in a direction generally opposite that of arrows 130 and 132 and then removing first edge or side surface 90 from stepped edge 72 or, alternatively, non-stepped edge 73 by guiding it in a direction generally opposite that of arrows 126 and 128. Next, reflector 94 would be removed from its position adjacent bottom surface 20 of shelf 12 by removing second edge surface 98 from stepped edge 72 or, alternatively, non-stepped edge 73 and first edge surface 96 from flange 48. Next, light module 14 would be moved upward to remove projecting members 62 and 64 from respective second portions or detents 84 and 86 and projecting members 66 and 68 from the second portions or detents of the mounting slot formed in end wall 40 and thereafter guiding light module 14 in a direction generally opposite that indicated by arrows 122 and 124 to remove projecting members 62 and 64 from mounting slot 46 formed in end wall 38 and projecting members 66 and 68 from the mounting slot formed in the end wall 40. Thereafter, light module 14 can be guided away from bottom surface 20 of shelf 12.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An assembly, comprising:

a shelf;

a light module having a housing, a portion of the housing cooperating with structure on the shelf to removably secure the light module to the shelf in a mounted position, the housing being formed of folded metal and including a flange that cooperates with the lens to support the lens and to secure the light module in the mounted position; and a lens disposed adjacent the light module and cooperating with the housing and the shelf to secure the light module against removal from the mounted position.

2. An assembly, comprising:

a shelf;

a light module having a housing, a portion of the housing cooperating with structure on the shelf to removably secure the light module to the shelf in a mounted position; and a lens disposed adjacent the light module, said lens having front and rear edges, said front edge being supported by the shelf and said rear edge being supported by the housing.

3. The apparatus of claim 1 or 2, wherein the housing includes a flange projecting from a sidewall of the housing that is positioned adjacent the lens.

4. The apparatus of claim 2, wherein the housing is formed of folded metal and includes a flange that cooperates with the lens to support the lens and to secure the light module in the mounted position.

5. The apparatus of claim 1 or 2, wherein the housing includes a pair of opposing end walls and wherein the portion of the housing cooperating with the structure on the shelf includes a slot formed in each of the end walls.

6. The apparatus of claim 5, wherein the slot includes first and second portions, the first and second portions being substantially orthogonally related.

7. The apparatus of claim 5, wherein the structure on the shelf includes at least one projecting member received in each of the slots.

8. The apparatus of claim 5, wherein the structure on the shelf includes a pair of mounting pins received in each of the slots.

9. The apparatus of claim 8, wherein each of the slots includes at least one detent aligned with at least one of the mounting pins when the light module is in the mounted position.

10. The apparatus of claim 1 or 2, wherein the structure on the shelf includes at least two members projecting into an area beneath the shelf.

11. The apparatus of claim 10, wherein the shelf includes a pair of depending end walls and the structure on the shelf includes a pair of mounting pins coupled to the end walls of the shelf.

12. The apparatus of claim 1 or 2, wherein the shelf comprises a stepped edge surface.

13. The apparatus of claim 12, wherein the lens rests on a portion of the stepped edge surface.

14. The apparatus of claim 12, further comprising a reflector disposed beneath the shelf and having a first edge surface abutting a portion of the housing and a second edge surface abutting a portion of the shelf to secure the reflector beneath the shelf.

15. The apparatus of claim 14, wherein the first edge surface abuts a flange formed on the housing and a second edge surface abuts the stepped edge surface of the shelf.

16. The apparatus of claim 14, wherein the reflector is configured to define an opening through which a bulb portion of the light module extends.

17. The apparatus of claim 1 or 2, wherein the shelf includes an edge surface formed to have first and second walls, the first wall being substantially orthogonal to the second wall and the lens being disposed on the second wall.

18. An assembly, comprising:

a shelf;

a light module including a housing having opposing end walls, each end wall having a slot formed therein, each slot comprising a first portion extending along a longitudinal length of the end wall and a second portion extending substantially orthogonal to the first portion; and at least one mounting pin coupled to the shelf adjacent each end wall of the housing, each pin being received by one of the adjacent slots to removably support the light module in a mounted position beneath the shelf.

19. The apparatus of claim 18, wherein each mounting pin is positioned in the second portion of the adjacent slot to secure the light module against removal when the light module is in the mounted position beneath the shelf.

20. The apparatus of claim 18, wherein the first portion of each slot has a first open end adjacent an edge of the end wall through which the at least one adjacent mounting pin is introduced into the slot.

21. The apparatus of claim 20, wherein the housing includes a sidewall extending between the opposing end walls that is formed to include a recessed portion adjacent the open end of the first portion of each slot to provide clearance for the at least one mounting pin.

22. The apparatus of claim 18, wherein the second portion of each slot is formed as a detent that aligns with the at least one mounting pin in the slot when the light module is in the mounted position.

23. A shelf light assembly, comprising:

a shelf having first and second engaging means;

a light module having a housing, said housing including third and fourth engaging means, wherein said third engaging means engages the first engaging means to removably secure the light module in a mounted position to the shelf;

a lens disposed adjacent the light module, said lens being supported at opposite edges by the second and fourth engaging means.

24. The apparatus of claim 23, wherein the securing means includes a slot formed in each of a pair of opposing end walls of the housing and at least one projecting member coupled to the shelf that is received in each of the slots.

25. The apparatus of claim 24, wherein the slot includes first and second portions, the portions being substantially orthogonally related.

26. The apparatus of claim 24, wherein the means on the shelf for securing the light module includes a pair of mounting pins received in each of the slots.

27. The apparatus of claim 26, wherein each of the slots includes at least one detent aligned with at least one of the mounting pins when the light module is in the mounted position.

28. The apparatus of claim 24, wherein the projecting members extend into an area beneath the shelf.

29. The apparatus of claim 23, wherein the cooperating means includes a flange projecting from a sidewall of the housing and an edge surface on the shelf, and further wherein the lens is supported on a first side by the edge surface of the shelf and on a second side by the flange.

30. The apparatus of claim 29, further comprising a reflector disposed beneath the shelf and having a first edge surface abutting the flange and a second edge surface abutting the edge surface of the shelf.

31. The apparatus of claim 29, wherein the edge surface of the shelf includes first, second, third, and fourth walls, the first and third walls being substantially parallel to one another, the second wall being substantially orthogonal to the first wall, and the fourth wall being substantially orthogonal to the third wall.

32. A method of installing a light assembly beneath a shelf having a pair of projecting members, the light assembly including a light module having a housing that includes a pair of opposing end walls each formed to include a slot having an open end, the slot extending along the end wall and formed to include at least one detent, comprising the steps of:

positioning the light module beneath the shelf so that each projecting member is adjacent one of the slots;

guiding each projecting member through the open end of the adjacent slot to dispose the projecting member within the slot; and positioning the projecting members into the at least one detent of the slot in which it is disposed to secure the light module in a mounted position beneath the shelf.

33. The method of claim 32, wherein the light assembly further includes a lens, and the method further includes the step of positioning the lens adjacent the housing of the light module and the shelf so that the lens cooperates with the light module and shelf to secure the light module against removal in the mounted position.

34. The method of claim 33, wherein the light assembly further includes a reflector having first and second opposing edge surfaces and the method further includes the steps of:

positioning the first edge surface of the reflector adjacent the housing of the light module; and positioning the second edge surface of the reflector adjacent the shelf thereby securing the reflector beneath the shelf.

35. The method of claim 32, wherein the light assembly further includes a lens having first and second opposing edge surfaces, the housing of the light module includes a flange, and the shelf includes an edge surface, and the method further includes the steps of:

positioning the first edge surface of the lens onto the edge surface of the shelf;

positioning the second edge surface of the lens adjacent the flange of the housing; and guiding the second edge surface of the lens onto the flange of the housing.

36. An assembly, comprising:

a shelf having a first engaging structure;

a light module having a housing, the housing including a second engaging structure which engages the first engaging structure to removably secure the light module to the shelf in a mounted position; and a lens disposed adjacent the light module and cooperating with the housing and the shelf to prevent the first and second engaging structure from being disengaged.

* * * * *